US009776339B2

(12) United States Patent
Kato et al.

(10) Patent No.: US 9,776,339 B2
(45) Date of Patent: Oct. 3, 2017

(54) MICROWAVE DRYING METHOD OF HONEYCOMB FORMED BODY

(71) Applicant: NGK INSULATORS, LTD., Nagoya (JP)

(72) Inventors: Shigeki Kato, Nagoya (JP); Mitsuharu Ono, Nagoya (JP)

(73) Assignee: NGK Insulators, Ltd., Nagoya (JP)

( * ) Notice: Subject to any disclaimer, the term of this patent is extended or adjusted under 35 U.S.C. 154(b) by 0 days.

(21) Appl. No.: 15/073,738

(22) Filed: Mar. 18, 2016

(65) Prior Publication Data

US 2016/0288364 A1 Oct. 6, 2016

(30) Foreign Application Priority Data

Mar. 31, 2015 (JP) ..... 2015-071536

(51) Int. Cl.
*F26B 3/347* (2006.01)
*B28B 11/24* (2006.01)
*H05B 6/80* (2006.01)

(52) U.S. Cl.
CPC ..... *B28B 11/241* (2013.01); *B28B 11/243* (2013.01); *F26B 3/347* (2013.01); *H05B 6/80* (2013.01); *F26B 2210/02* (2013.01); *H05B 2206/046* (2013.01)

(58) Field of Classification Search
CPC ..... F26B 3/347; B28B 11/241
USPC ..... 34/259
See application file for complete search history.

(56) References Cited

U.S. PATENT DOCUMENTS 4,439,929 A 4/1984 Kitagawa et al.
6,932,932 B2 8/2005 Miura et al.
7,017,278 B2 * 3/2006 Kato ..... B28B 11/241 219/699
7,197,839 B2 4/2007 Terazawa et al.
8,083,826 B2 * 12/2011 Ohno ..... B01D 39/2075 264/628

(Continued)

FOREIGN PATENT DOCUMENTS

JP 2001-172087 A1 6/2001
JP 2002-283329 A1 10/2002

(Continued)

OTHER PUBLICATIONS

Extended European Search Report (Application No. 16161660.2) dated Oct. 21, 2016.

*Primary Examiner* — Stephen M Gravini
(74) *Attorney, Agent, or Firm* — Burr & Brown, PLLC

(57) ABSTRACT

A microwave drying method includes: an introduction step of disposing a honeycomb formed body while keeping an axis direction X of cells of the honeycomb formed body vertically and introducing the honeycomb formed body into a drying furnace capable of irradiating with microwaves; a reflector placing step of placing a microwave reflector having a function to reflect the microwaves above and/or below around the honeycomb formed body; and a microwave drying step of irradiating with the microwaves while controlling temperature of an inside of the honeycomb formed body by the microwave reflector so that any one of the end faces (e.g., end face) of the honeycomb formed body reaches 100° C. to dry the honeycomb formed body after the other part of the honeycomb formed body reaches 100° C.

5 Claims, 6 Drawing Sheets

(56) References Cited

U.S. PATENT DOCUMENTS

| | | | | |
|---|---|---|---|---|
| 8,584,375 | B2 * | 11/2013 | Horiba | B28B 11/243 264/630 |
| 9,067,831 | B2 * | 6/2015 | Chapman | B29C 47/028 |
| 9,188,387 | B2 * | 11/2015 | Audinwood | F26B 3/347 |
| 9,441,879 | B2 * | 9/2016 | Saito | B28B 11/243 |
| 2002/0093123 | A1 | 7/2002 | Miura et al. | |
| 2002/0109269 | A1 | 8/2002 | Miura et al. | |
| 2003/0090038 | A1 * | 5/2003 | Ishikawa | B28B 11/241 264/432 |
| 2006/0042116 | A1 | 3/2006 | Terazawa et al. | |
| 2008/0023886 | A1 | 1/2008 | Adrian et al. | |
| 2011/0227256 | A1 * | 9/2011 | Okumura | F26B 3/343 264/414 |
| 2016/0288364 | A1 * | 10/2016 | Kato | B28B 11/241 |
| 2016/0288365 | A1 * | 10/2016 | Asakura | B28B 11/241 |

FOREIGN PATENT DOCUMENTS

| | | | | | |
|---|---|---|---|---|---|
| JP | 2006-088685 | A1 | | 4/2006 | |
| JP | 2016190396 | A | * | 11/2016 | B28B 11/241 |
| JP | 2016190397 | A | * | 11/2016 | B28B 11/241 |
| JP | EP 3095570 | A1 | * | 11/2016 | B28B 11/241 |

* cited by examiner

MICROWAVE DRYING METHOD OF HONEYCOMB FORMED BODY

The present application is an application based on JP 2015-071536 filed on Mar. 31, 2015 with the Japan Patent Office, the entire contents of which are incorporated herein by reference.

BACKGROUND OF THE INVENTION

Field of the Invention

The present invention relates to a microwave drying method of honeycomb formed body.

Description of the Related Art

Conventionally honeycomb structures made of ceramic have been used for a wide range of purposes, including a catalyst carrier to purify exhaust gas from automobiles, a filter to remove diesel particulates, and a heat storage member for combustion devices, for example. Such a honeycomb structure made of ceramic (hereinafter simply called a "honeycomb structure") is manufactured by cutting a honeycomb formed body, which is prepared by extruding a forming material (kneaded material) prepared beforehand using an extrusion machine into a desired shape, into individual pieces of honeycomb formed bodies, followed by the steps of drying and end-face finishing, and then a firing step to fire at a high temperature.

Especially in recent years, the development of a honeycomb structure having low-pressure loss has been demanded for the purpose of improving the fuel consumption and making the purification performance more efficient. In order to lower pressure loss, the partition wall making up cells of the honeycomb structure has to be made thinner. In this respect, a honeycomb structure is loaded with a catalyst, and when the catalyst is loaded on the surface of the partition wall, then the partition wall including the catalyst layer will be thick substantially, and so pressure loss after loading with catalyst increases. In order to make the catalyst layer at the surface of a partition wall as thin as possible, the partition wall is required to have a higher porosity as well so as to allow more catalyst to be loaded in the pores of the partition wall. In order to manufacture a honeycomb structure including a thin wall of higher porosity, more pore former has to be added to the forming material. Since a water absorbable pore former is used to make the fluidity of the forming raw material favorable during extrusion, the honeycomb formed body will contain more water.

For a drying step to dry a honeycomb formed body, a microwave drying method is used, which is to irradiate the honeycomb formed body with microwaves. In this method, as drying progress, the water content becomes less and the drying efficiency deteriorates, and so hot air drying is used in combination as the final drying (see Patent Documents 1, 2).

[Patent Document 1] JP-A-2002-283329

[Patent Document 2] JP-A-2006-88685

SUMMARY OF THE INVENTION

During microwave drying, incident microwaves are absorbed by water at the circumferential part and the end-face part of the honeycomb formed body, and so drying progress from the circumferential part and the end-face part to the inside. Since the honeycomb formed body contracts with the progress of drying, a center part thereof in which drying occurs later will receive pressure from the circumferential part and the end-face part which have been already dried. The honeycomb structure including a thin wall of higher porosity as stated above deteriorates in strength because the partition wall thereof is thinner, cells tend to be deformed at the center part of such a honeycomb formed body due to the pressure. Such deformation of the cells at the center part of the formed body is transmitted to the end-face part of the honeycomb formed body along the cell-extending direction, which greatly degrades the mechanical strength of the honeycomb structure. Such a phenomenon becomes noticeable especially when a large-sized honeycomb structure including a thin wall of higher porosity is manufactured, because a honeycomb formed body containing a lot of water has to be dried.

Microwaves are reflected at the inside of a drying furnace, and are incident on the circumferential part and the end-face part of the honeycomb formed body. According to a "microwave drying method of honeycomb formed bodies" disclosed in Patent Document 2, it is disclosed that a difference in drying speed inside of the honeycomb formed body is decreased during the drying step of the formed body, whereby deformation of the cells can be suppressed. Specifically, a honeycomb formed body is placed in a tubular shelter to reflect microwaves so as to control the incident density in the vertical direction (end-face direction) and the incident density in the horizontal direction (side-face direction) of the honeycomb formed body, and a difference in drying speed in the vertical direction of the honeycomb formed body can be reduced, and a difference in drying speed in the radial direction of the honeycomb formed body can be suppressed. In this case, however, since microwaves are incident only from the vertical direction of the honeycomb formed body, deformation of cells will occur inside of the honeycomb formed body similarly to the related art of the present application described later, and so such a technique cannot be applied.

Then in view of such circumstances, the present invention aims to provide a microwave drying method of a honeycomb formed body that, when the honeycomb formed body is dried by irradiating with microwaves, controls the temperature rising direction inside of the formed body during drying, whereby no defective shapes, such as deformation of cells of the honeycomb formed body, occur.

According to the present invention, a microwave drying method of a honeycomb formed body is provided.

[1] A microwave drying method of a honeycomb formed body, including: an introduction step of disposing the honeycomb formed body while keeping an axis direction of cells of the honeycomb formed body vertically and introducing the honeycomb formed body into a drying furnace capable of irradiating with microwaves; a reflector placing step of placing a microwave reflector having a function to reflect the microwaves so that a reflecting face of the microwave reflector faces at least one of upper and lower end faces of the honeycomb formed body; and a microwave drying step of irradiating with the microwaves while controlling temperature of an inside of the honeycomb formed body by the microwave reflector so that any one of the end faces of the honeycomb formed body reaches 100° C. to dry the honeycomb formed body after the other part of the honeycomb formed body reaches 100° C.

[2] The microwave drying method of a honeycomb formed body according to [1], wherein the microwave reflector includes a metal material.

[3] The microwave drying method of a honeycomb formed body according to [1] or [2], wherein the microwave reflector includes the reflecting face of a size enabling covering of the end face of the honeycomb formed body disposed to face the microwave reflector.

[4] The microwave drying method of a honeycomb formed body according to any one of [1] to [3], wherein the microwave reflector is made up of a flat-plate-shaped member, and includes a plurality of through holes penetrating from the reflecting face and a reflecting back surface of the microwave reflector, and the through holes have a diameter that is ¾ or less of a wavelength of the microwaves.

[5] The microwave drying method of a honeycomb formed body according to any one of [1] to [4], wherein at the microwave drying step, the microwaves of 2,450 MHz or 915 MHz in frequency are applied.

According to the microwave drying method of a honeycomb formed body of the present invention, a reflecting face of a microwave reflector is disposed so as to face at least one of upper and lower end faces of the honeycomb formed body so as to prevent delay of drying at the center part of the formed body and to allow any one of the end faces of the honeycomb formed body to reach 100° C. after the other part of the honeycomb formed body reaches 100° C., whereby defects of the honeycomb formed body, such as cell deformation, can be suppressed.

DESCRIPTION OF THE PREFERRED EMBODIMENTS

Figure 1:
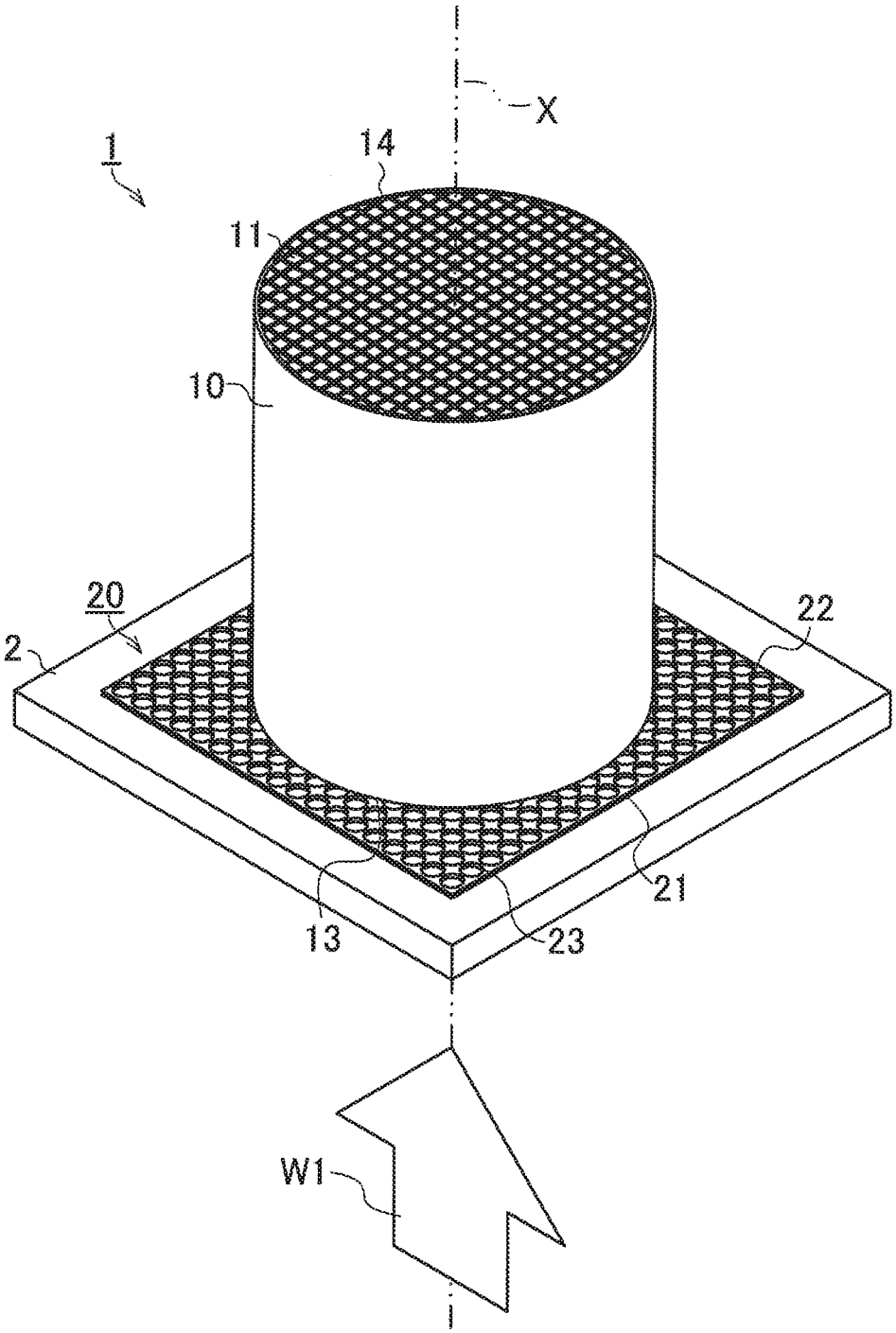
FIG. 1 schematically shows one example of a microwave reflector disposed below a honeycomb formed body and of microwaves to be reflected.

The following describes embodiments of a microwave drying method of a honeycomb formed body of the present invention, with reference to the drawings. The present invention is not limited to the following embodiments, to which changes, modifications and improvements may be added without deviating from the scope of the invention.

A microwave drying method of a honeycomb formed body that is one embodiment of the present invention (hereinafter simply called a "drying method 1") includes an introduction step of introducing a honeycomb formed body 10 into a drying furnace (not illustrated), a reflector placing step of placing a microwave reflector 20 around the honeycomb formed body 10 introduced, and a microwave drying step of irradiating the honeycomb formed body 10 to which the microwave reflector 20 is disposed with microwaves to dry the honeycomb formed body 10.

More specifically, the introduction step of the drying method 1 is to introduce a honeycomb formed body 10 into a drying furnace, the honeycomb formed body being formed through extrusion of a forming material prepared beforehand using an extrusion machine and cutting it into a predetermined length. The honeycomb formed body 10 is placed on a flat-plate-shaped conveyance pallet 12 while keeping the axis direction X of cells 11 (corresponding to the center axis direction of the honeycomb formed body 10, see FIG. 1) vertically.

The conveyance pallet 12 travels in the horizontal direction along the conveyance path defined between the inlet and the outlet of the drying furnace. Therefore, the honeycomb formed body 10 placed on the conveyance pallet 12 is introduced into the drying furnace along the horizontal direction, travels at a predetermined conveyance speed, and is led out through the outlet finally.

The conveyance speed of the conveyance pallet 12 traveling along the conveyance path is controlled, whereby the staying time of the honeycomb formed body 10 in the drying furnace is adjusted, and so the irradiation time of microwaves to evaporate water content included in the honeycomb formed body 10 can be controlled.

A plurality of such configurations each including the conveyance pallet 12 and the honeycomb formed body 10 is disposed so as to be connected to the conveyance path, whereby the plurality of honeycomb formed bodies 10 can be dried continuously. For the configuration used in the present embodiment, such as a drying furnace, a microwave drier (not illustrated) capable of irradiating with microwaves, and a conveyance pallet 12, existing devices can be used as they are. In a microwave drier, microwaves are introduced and applied from a waveguide tube into the drier, are reflected and diffused by a metal reflecting plate provided in the drier, and are incident on the honeycomb formed body 10. Herein a microwave drier is designed mainly so as to diffuse microwaves uniformly, and typically is not configured to control the incident direction to the honeycomb formed body 10.

Meanwhile the reflector placing step is to place the microwave reflector 20 equipped with a function of reflecting microwaves around the honeycomb formed body 10 introduced into the furnace. Microwaves as one type of electromagnetic waves typically have a property that, when they are applied to a metal material, they cannot penetrate into or enter into the metal material, and are reflected at the surface of the metal material. For instance, the microwave reflector 20 used in the present embodiment may be made of aluminum, copper or other well-known metal materials.

Herein, in the drying method 1 of the present embodiment, although the shape, the thickness or the like of the microwave reflector 20 used are not limited especially, the coverage factor R %(=R2/R1×100) of the area R2 of a reflecting face 21 of the microwave reflector 20 to the area R1 of the upper (or lower) end faces 13, 14 of the honeycomb formed body 10 is at least 50% or more, and 100% or more preferably. That is, the reflecting face has a size especially preferably so that the entire end face 13 or end face 14 of the honeycomb formed body 10 can be covered with the reflecting face 21 of the microwave reflector 20. Thereby, during microwave drying, an incidence of microwaves to the end face 13 or the end face 14 of the honeycomb formed body 10 can be shielded reliably by the microwave reflector 20 as stated above. Note here that the shape of the microwave reflector 20 is not limited especially, which may be of a rectangular shape in the plane as shown in FIGS. 1 to 3, for example, or may be of a circular shape corresponding to the shape of the end face 13 or the like of the honeycomb formed body 10.

Since reflection of microwaves occurs at the surface (reflecting face 21) of the microwave reflector 20 as stated above, there is no need that the entire microwave reflector 20 is made of a metal material as stated above. That is, a substrate (not illustrated) of the microwave reflector 20 may be made of a non-metal material, and then the surface of the substrate may be coated with aluminum foil or copper foil, for example, to form the reflecting face 21, paint including a metal material may be applied to the surface of the substrate, or a metal coating may be formed by plate processing.

Figure 2:
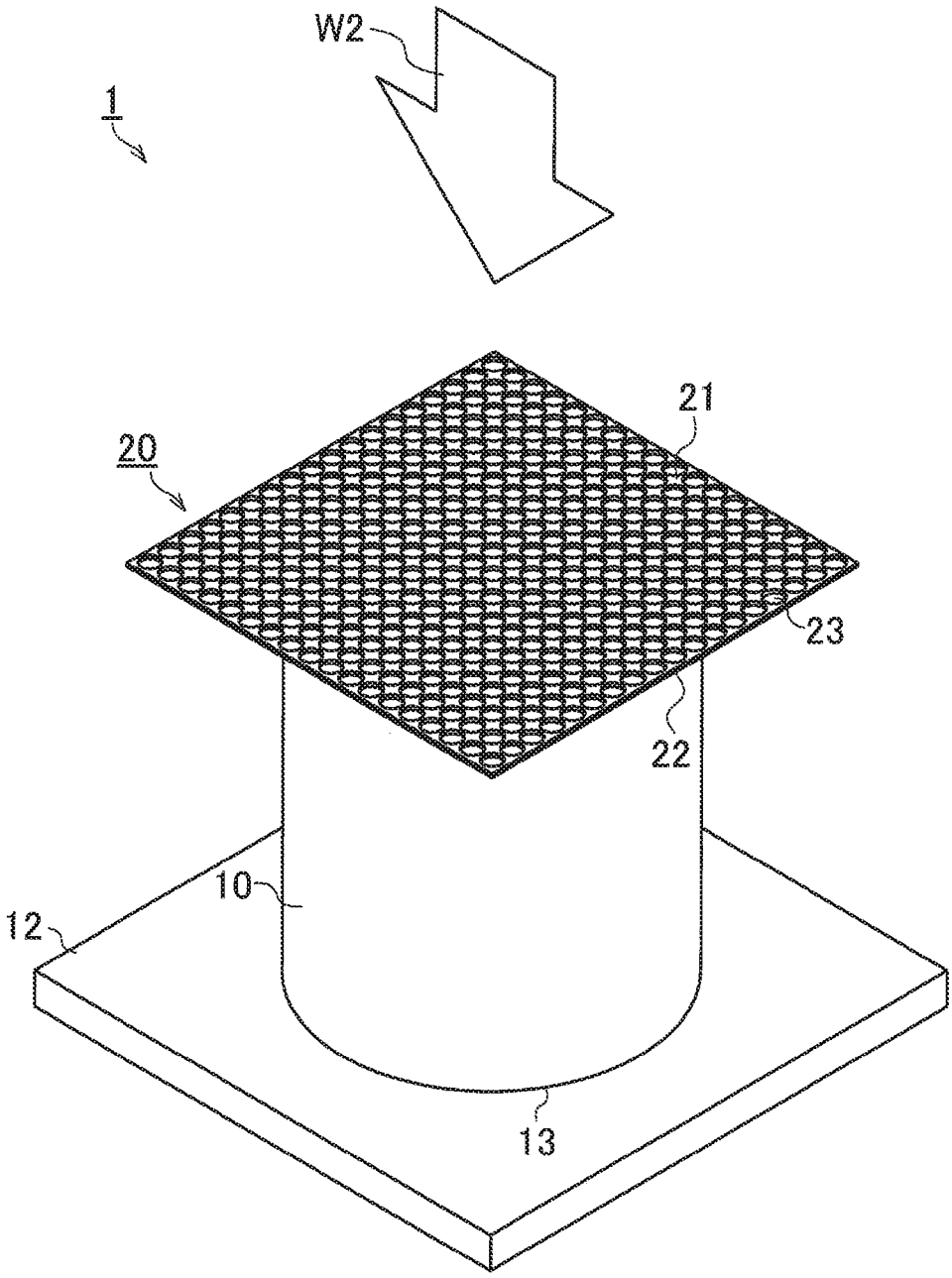
FIG. 2 schematically shows one example of a microwave reflector disposed above a honeycomb formed body and of microwaves to be reflected.
Figure 3:
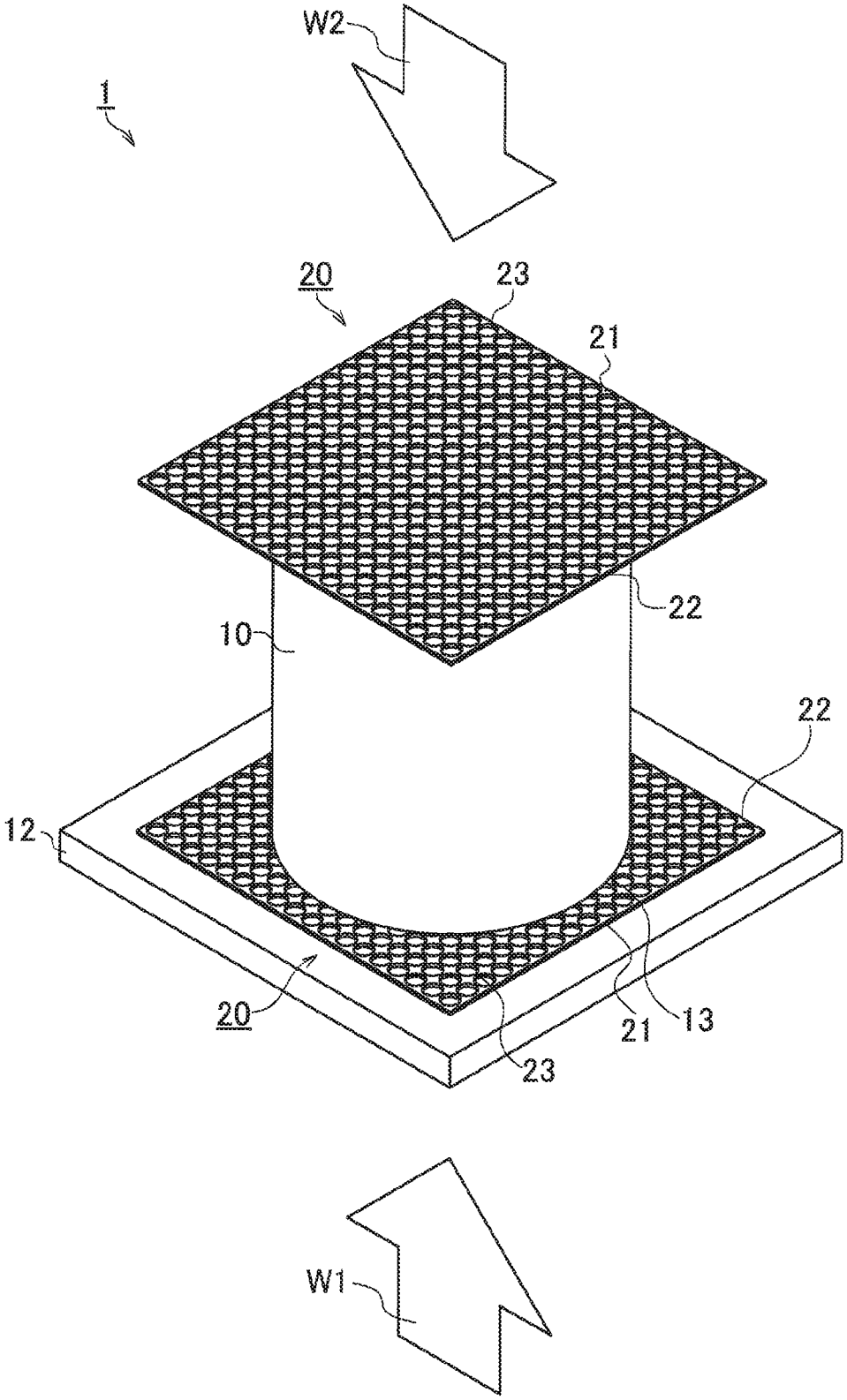
FIG. 3 schematically shows one example of a microwave reflector disposed above and below a honeycomb formed body and of microwaves to be reflected.

The microwave reflector 20 used in the drying method 1 of the present embodiment is made up of a rectangular flat-plate-shaped member as shown in FIGS. 1 to 3, which may be made up of a circular plate member. A plurality of through holes 23 of a circular shape in cross section is bored so as to penetrate from the reflecting face 21 facing the honeycomb formed body 10 to a reflecting back surface 22 opposed to the reflecting face. Herein the through holes 23 have a function to facilitate the release of water vapor from the end faces 13, 14 of the honeycomb formed body 10 to which the microwave reflector 20 is disposed.

The through holes 23 of a circular shape in cross section have the diameter that is set to be ¾ or less of the wavelength λ of microwaves that a microwave oscillator of the microwave drier generates in the drying furnace. Such a diameter of the through holes 23 to be ¾ or less of the wavelength λ prevents the incident microwaves from passing through the through holes 23. As a result, microwaves incident on the honeycomb formed body 10 can be shielded by the microwave reflector 20.

The thus configured reflecting face 21 of the microwave reflector 20 is disposed so as to face at least one of the upper and lower end faces 13 and 14 of the honeycomb formed body 10 as the honeycomb formed body is introduced into the drying furnace. Herein, the microwave reflector 20 may be disposed below the honeycomb formed body 10 (see FIG. 1) so that it faces the lower end face 13 of the honeycomb formed body 10, in which the axis direction X of the cells 11 is kept along the vertical direction, may be disposed above the honeycomb formed body 10 (see FIG. 2) so that it faces the upper end face 14 of the honeycomb formed body 10, or a pair of the microwave reflectors 20 may be disposed below and above the honeycomb formed body 10 (see FIG. 3) so that they face the lower end face 13 and the upper end face 14 of the honeycomb formed body 10, for example.

At this time, the microwave reflector 20 may be disposed with respect to the honeycomb formed body 10 so that the reflecting face 21 of the microwave reflector 20 comes into direct contact with the end face 13, 14, or so that the end face 13, 14 and the reflecting face 21 are kept away from each other. In the former case, prior to the introduction step to introduce the honeycomb formed body 10 into the drying furnace, the honeycomb formed body 10 has to be placed on the microwave reflector 20, or the microwave reflector 20 has to be placed on the upper end face of the honeycomb formed body 10. On the contrary, in the latter case, the microwave reflector 20 is disposed at an upper or lower position in the furnace, so as to prevent microwaves from being incident on the specific end face 13, 14 of the honeycomb formed body 10 being conveyed.

The microwave drying step is to irradiate the honeycomb formed body 10 to which the microwave reflector 20 is disposed as stated above with microwaves of a specific frequency, so as to evaporate water content included in the honeycomb formed body 10 and dry the honeycomb formed body 10. The frequency of microwaves used in the drying method 1 of the present embodiment is set at 2,450 MHz or 915 MHz that is used in a typical microwave drying method.

The microwave reflector 20 is disposed so as to face at least one of the upper and lower end faces 13 and 14 of the honeycomb formed body 10, whereby microwaves, which are incident on the at least one of the end faces 13 and 14 of the honeycomb formed body 10 and are reflected, can be shielded, and temperature rising at the end face 13 (or the end face 14) on the side where the microwave reflector 20 is disposed can be delayed.

As a result, the temperature can be controlled so that any one of the end faces 13 and 14 reaches 100° C. after the other part of the honeycomb formed body reaches 100° C. That is, control can be performed so that the position where the temperature finally reaches 100° C. that is the boiling point of water can be located at any one of the upper and the lower end faces 13 and 14 of the honeycomb formed body 10, and so a part around the center inside of the honeycomb formed body 10 can be dried earlier than the end face 13, 14.

Although the part where drying is delayed receives pressure from the surrounding, the finally drying part is set at the end face 13 (or the end face 14), whereby such pressure from the surrounding can be released. Thereby, a defect caused by cell deformation generated at a part around the center inside of the formed body can be suppressed. Herein, the degree of contraction of the honeycomb formed body 10 due to drying depends on the ratio of water content included in the honeycomb formed body 10, and the effect of pressure release as stated above is especially favorable for a honeycomb formed body having a high ratio of water content, and for a honeycomb formed body having the ratio of a water content that is 30% or more preferably. Such an effect is especially effective when the frequency of microwaves is 2,450 MHz at which electric power of the microwaves reduces to be half at a shallower part.

Especially defects due to cell deformation at a part around the center inside of the formed body are suppressed, whereby the honeycomb structure (not illustrated) obtained by firing the dried honeycomb formed body 10 can keep mechanical strength, especially isostatic strength (hydrostatic pressure break strength) to be a certain degree or more. As a result, the strength of the honeycomb structure including a thin wall of higher porosity can be kept, and when it is used as a product, the product can have sufficient strength for practical use.

When the microwave reflector 20 is disposed so as to face the lower end face 13 of the honeycomb formed body 10 as shown in FIG. 1, microwaves W1 incident on the honeycomb formed body 10 from below are reflected by the microwave reflector 20 provided at the end face 13 of the honeycomb formed body 10. Thereby, an incidence of the microwaves W1 on the lower end face 13 of the honeycomb formed body 10 facing the microwave reflector 20 is inhibited. On the contrary, microwaves incident on the honeycomb formed body 10 from above and laterally heat the honeycomb formed body 10 from the above and laterally.

Figure 5:
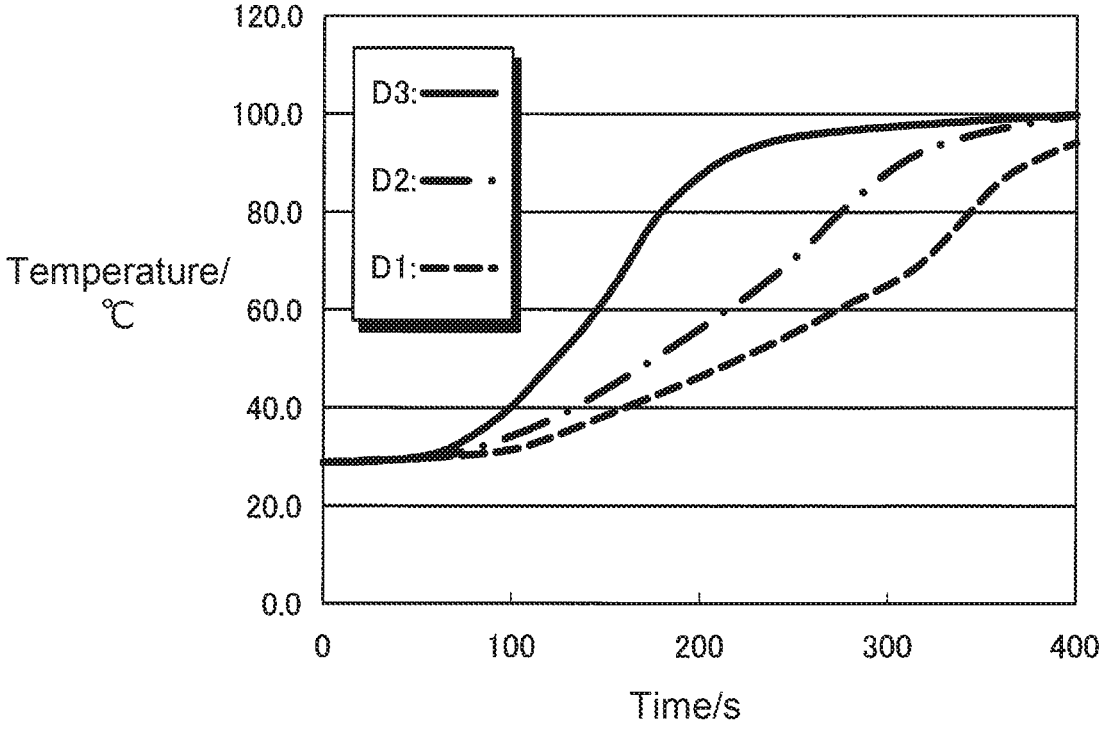
FIG. 5 is a graph showing the temperature measurement result inside of a honeycomb formed body during microwave drying of the formed body using a microwave reflector.
Figure 6:
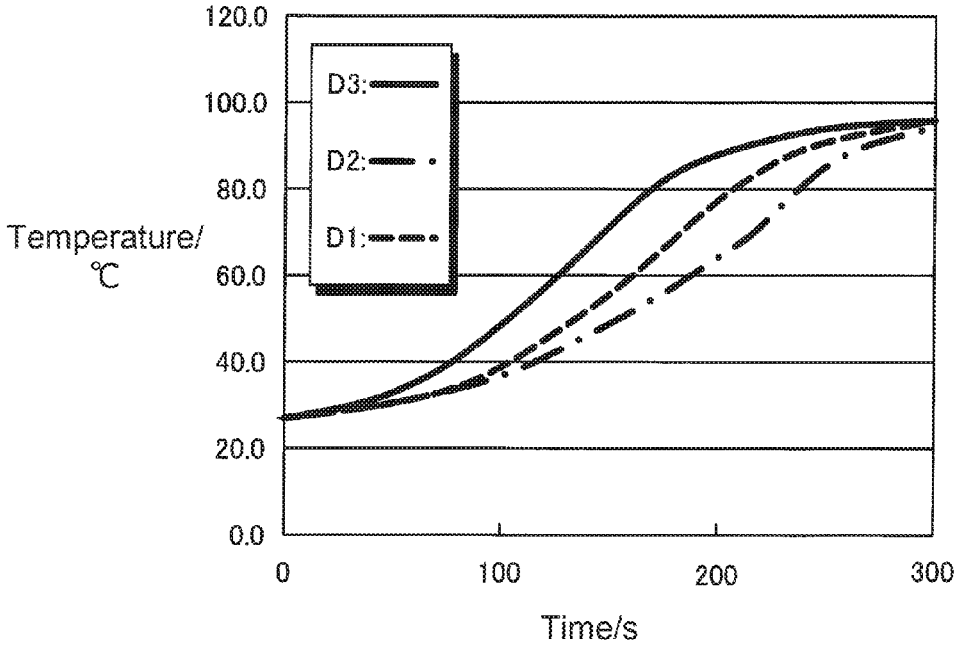
FIG. 6 is a graph showing the temperature measurement result inside of a honeycomb formed body during microwave drying of the formed body without using a microwave reflector.
Figure 8:
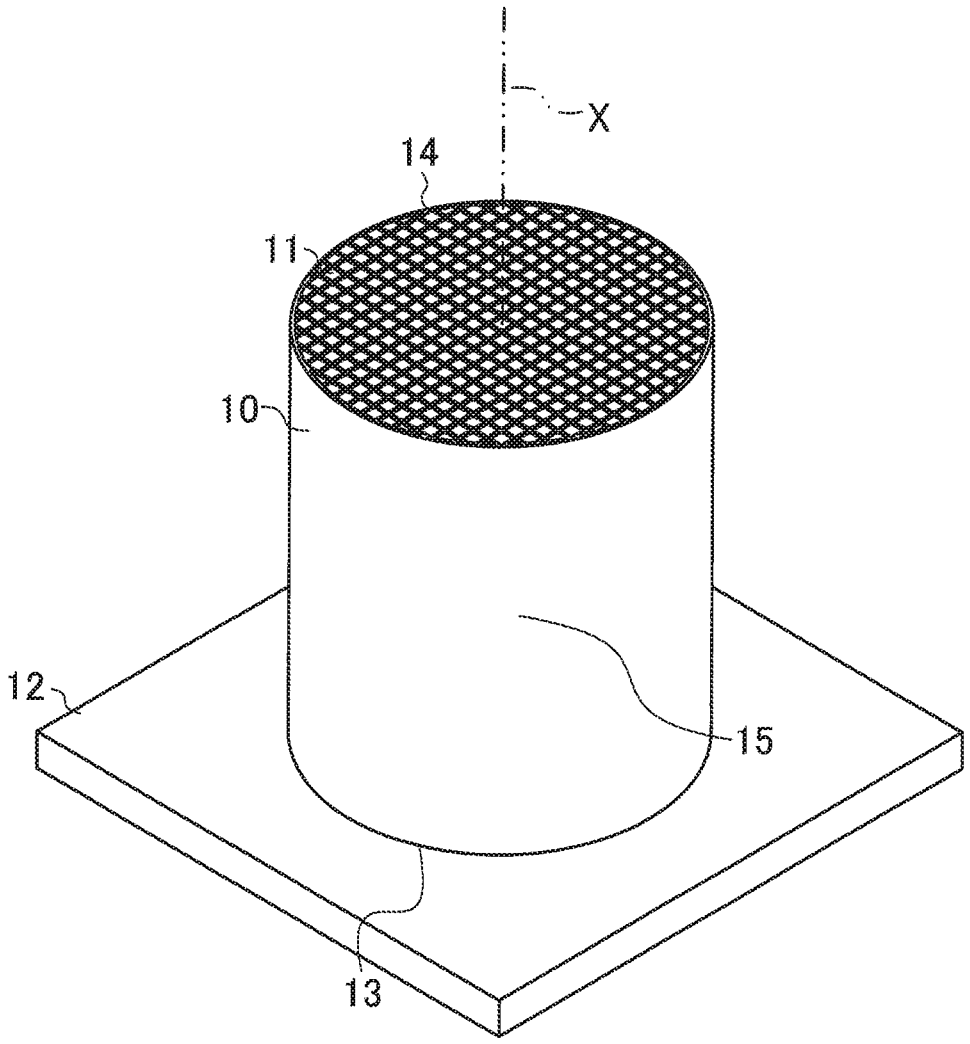
FIG. 8 schematically shows one example of microwave drying of a honeycomb formed body without using a microwave reflector.

The effect to control the microwave incident direction as stated above is described, by way of the result of temperature measurement. FIGS. 5 and 6 show the result of temperature measurement at three points of the lower part D1, the center part D2 and the upper part D3 of the honeycomb formed body shown in FIG. 4 (the details of temperature measurement are described later). When the microwave reflector 20 is disposed so as to face the lower end face 13 of the honeycomb formed body 10 (see FIG. 1), the temperature at the region of the upper part D3 close to the upper end face 14 rises firstly, then the temperature at the region of the center part D2 close to the center part 15 of the formed body rises, and finally the temperature at the region of the lower part D1 close to the end face 13 reaches 100° C. as shown in FIG. 5. That is, the microwave reflector 20 disposed so as to face the lower end face 13 of the honeycomb formed body 10 can control the duration to reach 100° C. to be in the order of the upper part D3→the center part D2→the lower part D1. On the contrary, when the microwave reflector 20 is not disposed around the honeycomb formed body 10 as shown in FIG. 8, i.e., in the case of a conventional microwave drying method, the honeycomb formed body is heated from the vertical direction and laterally due to microwaves incident in the vertical direction and laterally. As a result, as shown in FIG. 6, the temperature of the honeycomb formed body 10 starts to rise at the regions of the upper part D3 and the lower part D1 close to the end faces 14 and 13 firstly, and then the temperature at the region of the center part D2 of the center part 15 of the formed body rises finally. That is, the center part 15 of the formed body reaches 100° C. after the other part of the honeycomb formed body reaches 100° C. where water evaporates. Therefore, defects due to cell deformation at the center part D2 of the center part 15 of the formed body occur.

On the contrary, when the microwave reflector 20 is disposed so as to face the upper end face 14 of the honeycomb formed body 10 as shown in FIG. 2, microwaves W2 incident on the honeycomb formed body 10 from above are reflected by the microwave reflector 20 provided at the end face 14 of the honeycomb formed body 10. Thereby, an incidence of the microwaves W2 on the upper end face 14 of the honeycomb formed body 10 facing the microwave reflector 20 is inhibited. On the contrary, microwaves incident on the honeycomb formed body 10 from below and laterally heat the honeycomb formed body 10 from the below and laterally.

Since the upper end face 14 of the honeycomb formed body 10 is shielded by the microwave reflector 20, the temperature rise starts at the region of the lower part D1 close to the lower end face 13, followed by at the region of the center part D2 close to the center part 15 of the formed body, and finally the temperature at the region of the upper part D3 close to the end face 14 reaches 100° C. That is, the duration to reach 100° C. can be controlled to be in the order of the lower part D1→the center part D2→the upper part D3.

On the contrary, when a pair of the microwave reflectors 20 is disposed so as to face the upper and lower end faces 13 and 14 of the honeycomb formed body 10 as shown in FIG. 3, microwaves W1 and W2 incident on the honeycomb formed body 10 from above and below are reflected by the pair of microwave reflector 20 provided at the end faces 13 and 14 of the honeycomb formed body 10. Thereby, an incidence of the microwaves W1 and W2 on the lower end face 13 and the upper end face 14 of the honeycomb formed body 10 facing the microwave reflectors 20 is inhibited. On the contrary, microwaves incident on the honeycomb formed body 10 laterally heat the honeycomb formed body 10 laterally. That is, viewed along the center axis (axis direction X) of the honeycomb formed body 10, the temperature rise is delayed in the regions close to the end faces 13 and 14 other than the other region of the honeycomb formed body 10. Therefore, the end face 13 or the end face 14 will reach 100° C. after the other part of the honeycomb formed body reaches 100° C.

As described above, according to the drying method 1 of the present embodiment, the microwave reflector 20 is disposed around the honeycomb formed body 10 introduced to the drying furnace, whereby temperature rises inside of the formed body can be controlled so that the temperature reaches 100° C. that is the boiling point of water finally at any one of the end faces 13 and 14. A honeycomb formed body can be dried stably while suppressing cell deformation due to drying and contraction, and further a honeycomb structure obtained by firing the honeycomb formed body can keep mechanical strength (especially isostatic strength) to be a certain standard or more. Thereby, the quality of the honeycomb structure as the product can be made stable.

The drying method 1 of the present embodiment does not require any new special facility to be added, and can exert the excellent effect as stated above with simple modification of disposing the microwave reflector 20 at a predetermined position with respect to the honeycomb formed body 10 using an existing drying furnace or the like, and so without increasing the cost for facility, for example.

The following describes the microwave drying method of a honeycomb formed body of the present invention, by way of the following Examples, and the microwave drying method of a honeycomb formed body of the present invention is not limited to these Examples.

EXAMPLES (1) Formation of Honeycomb Formed Body

The following Table 1 shows components blended in the forming material of each honeycomb formed body of Examples 1 to 7 and Comparative Example 1, their blend ratios, the conditions to mix the forming raw materials, the conditions to form during extrusion of the forming materials, the cell structure (partition wall thickness and cell density) of the honeycomb formed bodies after extrusion, the honeycomb diameters, and the lengths of the honeycomb formed bodies. Herein for Examples 1 to 7 and Comparative Example 1, the honeycomb formed bodies were used, which were formed based on Table 1 and including the cordierite forming raw material formed under the same condition to manufacture a honeycomb structure having a thinner wall. Since the details of the forming step to form the honeycomb formed bodies are well known, their detailed descriptions are omitted.

TABLE 1

| | | | | Ex. 1 to 7, Comp. Ex. 1 |
|---|---|---|---|---|
| Forming material | Cordierite forming raw material | | parts by mass | 100 |
| | forming aid | Methylcellulose | parts by mass | 6 |
| | | Surfactant | parts by mass | 1 |
| | | Water absorbable polymer | parts by mass | 2.5 |
| | | Water ratio | parts by mass | 58 |
| | | Theoretical water ratio (internal water distribution ratio) | % | 36.7 |
| Mixing condition | Mixer wet mixing duration | | s | 180 |
| | Mixer dry mixing duration | | s | 240 |
| Forming condition | Forming device type | | | biaxial forming device |
| Honeycomb formed body | Partition wall thickness | | μm | 100 |
| | Cell density | | pieces/cm$^2$ | 93 |
| | Honeycomb diameter | | mm | 384 |
| | Length of honeycomb formed body | | mm | 280 |

(2) Microwave Drying Conditions

The honeycomb formed bodies formed by the above (1) according to Examples 1 to 7 and Comparative Example 1 were introduced into a drying furnace for microwave drying, and were irradiated with microwaves of a predetermined frequency and wavelength, so as to evaporate water content included in the honeycomb formed bodies, thus performing microwave drying of the honeycomb formed bodies. The following Table 2 shows their microwave drying conditions for the honeycomb formed bodies collectively. In the drying furnace, the opening of the microwave guide tube was located above the honeycomb formed body 10.

TABLE 2

| Microwave drying condition | | Ex. 1 | Ex. 2 | Ex. 3 | Ex. 4 | Ex. 5 | Ex. 6 | Ex. 7 | Comp. Ex. 1 |
|---|---|---|---|---|---|---|---|---|---|
| Frequency | MHz | 2450 | | | | | | 915 | 2450 |
| Total output power | kW | 200 | | | | | | | |
| reflector | | used | | | | | | | not used |
| Coverage factor R (=area R2 of reflecting face/area R1 of end face × 100) | % | 100 | | | | 50 | 100 | | — |
| Material of microwave reflector | — | aluminum | | | copper | aluminum | | | — |
| Position of microwave reflector | — | lower | upper | upper, lower | lower | lower | lower | lower | — |
| Diameter of through holes | mm | 5 | | | | 80 | | 5 | — |
| Open frontal area of microwave reflector | % | 40 | | | | 70 | | 40 | — |
| Temperature measurement position | | upper (D3), center (D2), lower (D1): see FIG. 4 | | | | | | | |
| Conveyance speed | m/min | 0.6 | | 0.48 | | 0.6 | | | |

Giving a detailed description of the microwave drying conditions for these Examples and Comparative Example, Examples 1 to 3 were to examine a difference in the disposition position of the microwave reflector with respect to the honeycomb formed body, that is, in Example 1 the microwave reflector was disposed below the honeycomb formed body (see FIG. 1), in Example 2 the microwave reflector was disposed above the honeycomb formed body (see FIG. 2) and in Example 3 the microwave reflectors were disposed above and below the honeycomb formed body (see FIG. 3). Note here that in Example 3, the conveyance speed was set at 0.48 m/min. Note here that in each of the other Examples and Comparative Example, the conveyance speed was set at 0.6 m/min.

On the contrary, in Example 4, copper was used as the metal material making up the microwave reflector. In the other Examples 1 to 3 and 5 to 7, aluminum was used as their microwave reflectors.

In Example 5, the coverage factor R of the reflecting face of the microwave reflector with reference to the end face of the honeycomb formed body was 50%. That is, in Example 5, instead of covering the entire end face of the honeycomb formed body opposed with the disposed microwave reflector, the microwave reflector used included the reflecting face having the area R2 that was 50% of the area R1 of the end face. In the other Examples and Comparative Example, such a coverage factor R was 100% (or more), meaning that the entire end face was covered with the microwave reflector (other than Comparative Example 1).

In Example 6, a plurality of through holes bored at the microwave reflector each had the diameter of 80 mm and the open frontal area of 70%. In the other Examples, their through holes had the diameter of 5 mm and the open frontal area of 40% (other than Comparative Example 1). They all had the diameter that was ¾λ or less of the wavelength λ of microwaves. In Example 7, the frequency of microwaves applied to the honeycomb formed body was set at 915 MHz. In the other Examples and Comparative Example, the frequency of microwaves was set at 2,450 MHz. On the contrary, in Comparative Example 1, no microwave reflector was disposed for the honeycomb formed body. That is, it had the same condition as conventional microwave drying of a honeycomb formed body (see FIG. 8). For the other microwave drying conditions, the total output power of microwaves was 200 kW in each of Examples as well as Comparative Example.

(3) Temperature Measurement Inside of Formed Body

To examine a temperature change at various portions inside of the honeycomb formed body by means of the microwave reflector, a temporal change of the temperature inside of the honeycomb formed body introduced into the drying furnace was measured. The temperature inside of the formed body was measured by embedding a button battery type ultra-small temperature recorder (product name: Superthermochron, produced by KN Laboratories, Inc.) directly into the honeycomb formed body, and loading temperature data acquired by such an ultra-small temperature recorder into a computer for analysis, whereby a temperature change inside of the formed body in the drying furnace was measured.

Figure 4:
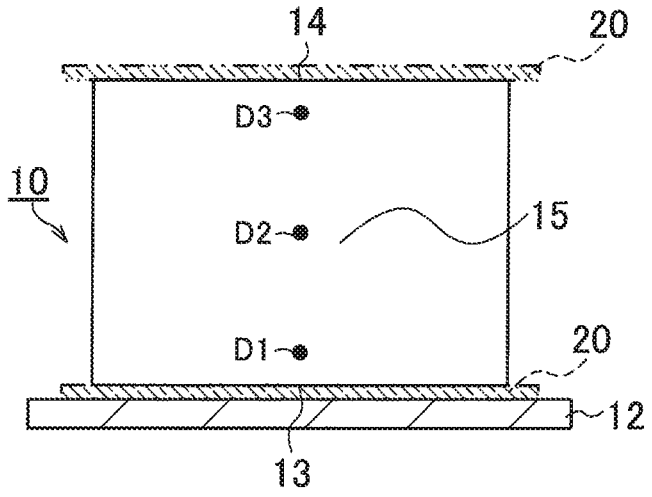
FIG. 4 explains the temperature measurement positions inside of a honeycomb formed body that is placed on a conveyance pallet.

As shown in FIG. 4, the ultra-small temperature recorder was disposed at three positions including a position below from the upper end face of the honeycomb formed body by 30 mm (upper part D3), at a center position of the honeycomb formed body (center part D2) and at a position above from the lower end face of the honeycomb formed body by 30 mm (lower part D1), which were along the center axis direction of the honeycomb formed body. The temperature measurement range by the ultra-small temperature recorder was 0 to 120° C. In FIG. 4, a two-dot chain line above or below the honeycomb formed body indicates a microwave reflector disposed above, below or above and below.

The following Table 3 shows the results of microwave drying of the honeycomb formed bodies shown in Table 1 under the microwave drying conditions shown in Table 2.

TABLE 3

| Items | | | | Ex. 1 | Ex. 2 | Ex. 3 | Ex. 4 | Ex. 5 | Ex. 6 | Ex. 7 | Comp. Ex. 1 |
|---|---|---|---|---|---|---|---|---|---|---|---|
| | Finally reaching position to 100° C. | | — | lower | upper | lower | lower | lower | lower | lower | center |
| | Scattering ratio by microwaves (after drying) * | | % | 93 | 91 | 89 | 90 | 95 | 94 | 93 | 95 |
| Cell deformation | Generated position | Upper | — | none | none | none | none | none | none | none | none |
| | | Center | — | none | none | none | none | mild twisting | mild twisting | none | cross-shaped deformation |
| | | Lower | — | none | none | none | none | none | none | none | none |

* calculated while setting theoretical water ratio at 100%

(4) Results of Drying of Honeycomb Formed Body (4-1) Finally Reaching Position at 100° C.

As shown in Table 3, in each case where the microwave reflector was disposed below the honeycomb formed body (Examples 1, 4 to 7), the position reaching 100° C. finally was the lower part D1 in the vicinity of the end face 13 facing the microwave reflector disposed. When it was disposed above (Example 2), the position reaching 100° C. finally was the upper part D3 in the vicinity of the end face 14 facing the microwave reflector disposed. It was confirmed that, by changing the disposition position of the microwave reflector with respect to the honeycomb formed body, temperature rise inside of the honeycomb formed body can be controlled, and any one of the sides of the honeycomb formed body was allowed to reach 100° C. finally. When the microwave reflectors were disposed above and below (Example 3), the position reaching 100° C. finally was the lower part D1 in the vicinity of the end face 13. When no microwave reflector was disposed (Comparative Example 1), the position reaching 100° C. finally was the center part D2.

As described above, according to the microwave drying method of a honeycomb formed body of the present invention, a microwave reflector was disposed around the honeycomb formed body, whereby the position reaching 100° C. finally can be controlled to a position close to the end face of the honeycomb formed body. Note here that in Example 3 where the microwave reflectors were disposed above as well as below, the temperature started to rise at a part close to the center of the honeycomb formed body where shielding of microwaves did not occur, and the temperature rose toward above and below. Therefore, the lower part D1 reached 100° C. finally as in Example 3. Although there is a possibility that the upper part D3 reaches 100° C. finally depending on the drying condition, in any case the temperature rise can be controlled so that the temperature reaches 100° C. finally at a position close to the end face of the honeycomb formed body.

The graph in FIG. 5 shows the results of temperature measurement inside of the formed body during microwave drying, to which a microwave reflector was disposed below thereof (Example 1). The horizontal axis of the graph represents the elapsed time since the introduction into the drying furnace. The graph shows that, although a difference in temperature hardly was found among the temperature measurement positions (upper part D3, center part D2 and lower part D1) immediately after introduction into the drying furnace, after 60 s elapsed since the introduction, the temperature at the upper part D3 rose sharply. Subsequently, following the upper part D3, the temperature at the center part D2 rose gently, and finally the temperature at the lower part D1 started to rise behind the upper part D3 and the center part D2 around after 100 s elapsed. Subsequently, whereas the temperature reached about 100° C. at the upper part D3 and the center part D2 at the stage of 400 s elapsed since the introduction, the temperature at the lower part D1 reached just about 94° C. This result shows that, by disposing the microwave reflector below the honeycomb formed body, the end face of the lower part D1 reaches 100° C. after the other part of the honeycomb formed body reaches 100° C.

On the contrary, the graph in FIG. 6 shows the temperature change on the inside of the honeycomb formed body during microwave drying, to which no microwave reflector was disposed (Comparative Example 1, see FIG. 8). The graph shows that after around 30 s elapsed since the introduction of the drying furnace, the temperature at the upper part D3 rose, and subsequently, following the upper part D3, the temperature at the lower part D1 rose, and finally the temperature at the center part D2 started to rise behind the upper part D3 and the lower part D1 around after 100 s elapsed. This shows that, in the case of Comparative Example 1 unlike Example 1, the order of temperature rising at the center part D2 and the lower part D1 was reversed, and the temperature at the center part D2 finally reached 100° C. Such a delay in temperature rising at the lower part than the upper part was presumably due to an influence from the conveyance pallet as stated above. Further since no microwave reflector was present to shield microwaves, the duration to reach 100° C. was shorter than that in FIG. 5.

(4-2) Deformation of Cells

Cells at around the upper part D3, the center part D2 and the lower part D1 of the honeycomb formed bodies after drying were checked as to whether they were deformed or not. As a result, no deformation of cells was found in all of the honeycomb formed bodies of Examples 1 to 4 and 7. That is, the advantageous effects of the present invention can be obtained also when the microwave reflectors were disposed above and below the honeycomb formed body as in Example 3, when the microwave reflector was made of copper as in Example 4, and when the frequency of microwaves applied was changed to 915 MHz as in Example 7. On the contrary, mild deformation of cells was found in the honeycomb formed bodies of Example 5 and Example 6 at a part around the center part D2. However, the measurement of isostatic strength described later showed that such honeycomb formed bodies had a sufficient strength as the product of the honeycomb structure, and had a quality without problems for practical use. In this way, the result of Example 5 and Example 6 clearly shows that the configuration including a microwave reflector of a size covering the entire end face of the honeycomb formed body and the configuration including through holes of the microwave reflector having a diameter as small as possible and that is ¾ or less of the wavelength λ of microwaves are more preferable.

On the contrary, cross-shaped deformation of cells was found at around the center part D2 of the honeycomb formed body of Comparative Example 1. Therefore, it was confirmed that a microwave reflector disposed greatly contributes to whether the cells are deformed or not (Comparative Example 1).

(5) Formation of Honeycomb Structure

Figure 7:
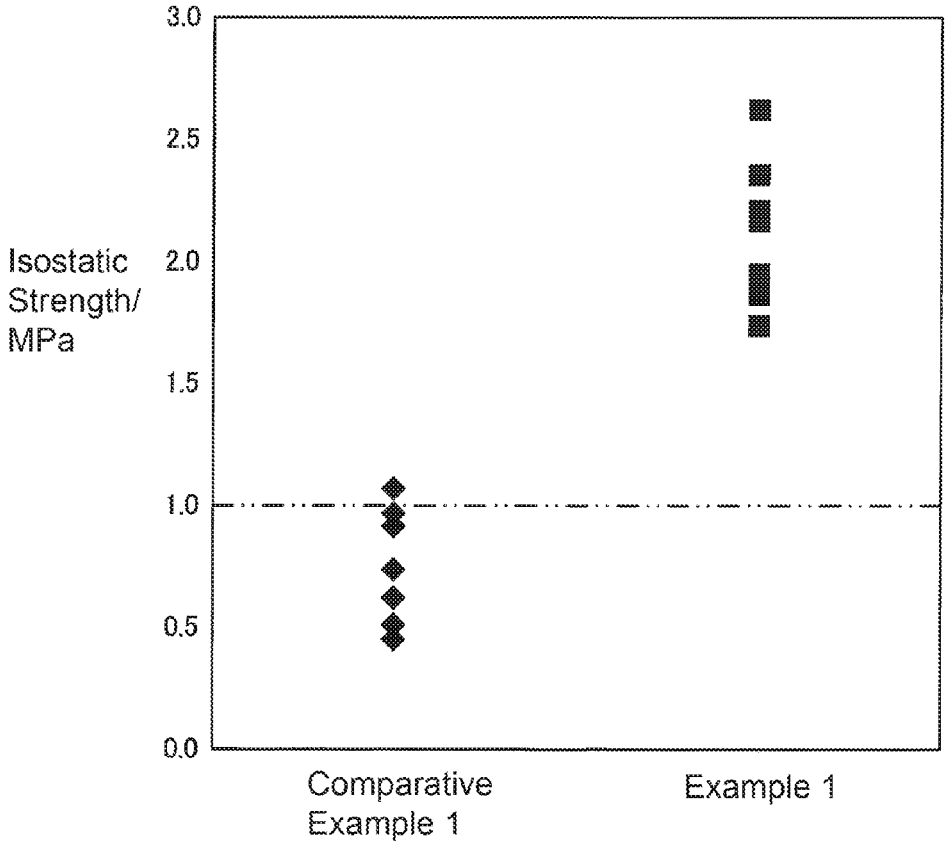
FIG. 7 is a graph showing isostatic strength of honeycomb structures of Example 1 and Comparative Example 1.

For the honeycomb formed bodies of Examples 1 to 7 and Comparative Example 1 subjected to microwave drying, hot air drying at 120° C. was performed, followed by finishing using a finisher to cut the end faces of the honeycomb formed body with a grinding wheel. At this time, finishing allowance by cutting with a grinding wheel was 35 mm. Subsequently they were introduced into a firing furnace in oxidant atmosphere for firing under the firing conditions at 1,430° C. for 3 hours, whereby honeycomb structures were formed. For the honeycomb structures after firing, circumferential processing and circumferential coating were performed. The thus obtained honeycomb structures all had the porosity of 50% and the pore diameter of 20 μm. The following Table 4 and FIG. 7 show the conditions to form these honeycomb structures and the measurement result of the average isostatic strength of the obtained honeycomb structures.

TABLE 4

| Items | | | Ex. 1 | Ex. 2 | Ex. 3 | Ex. 4 | Ex. 5 | Ex. 6 | Ex. 7 | Comp. Ex. 1 |
|---|---|---|---|---|---|---|---|---|---|---|
| Hot air drying | Drying temperature | ° C. | 120 | | | | | | | |
| Finishing | Finisher | finishing method | cut by grinding wheel | | | | | | | |
| | Finishing allowance | mm | 35 | | | | | | | |
| Firing | Firing furnace in oxidant atmosphere | — | held at 1430° C. × for 3 hours. | | | | | | | |
| Circumferential processing | Processing size | mm × mm | ϕ328 × 203 | | | | | | | |
| Circumferential coating | Coating thickness | — | 1 mm on single side | | | | | | | |
| Honeycomb structure | Porosity | % | 50 | | | | | | | |
| | Pore diameter | μm | 20 | | | | | | | |
| Evaluations on honeycomb structure | Isostatic strength | MPa | 2.1 | 2.1 | 2.0 | 2.1 | 1.5 | 1.8 | 2.1 | 0.8 |

(6) Method for Measuring Isostatic Strength and Evaluation

Measurement of isostatic strength was performed using the samples of the honeycomb structures obtained according to Examples 1 to 7 and Comparative Example 1 using an isostatic strength tester in accordance with the measurement method of isostatic break strength specified at M505-87 of the Japanese Automotive Standards Organization (JASO) that is a specification issued by the Society of Automotive Engineers of Japan.

As shown in Table 4, all of the honeycomb structures of Examples 1 to 7 had the average isostatic strength of 1.0 MPa or more. Since the standard of isostatic strength without problems for practical use according to the above specification is 1.0 MPa or more (see the two-dot chain line in FIG. 7), the honeycomb structures of Examples 1 to 7 meet such a standard, showing that they had sufficient strength as the product of the honeycomb structures. Further as shown in FIG. 7, whereas Comparative Example 1 (♦) had isostatic strength values, most of which was 1.0 MPa or less, the isostatic strength of Example 1 (■) was improved to 1.0 MPa or more. In this way, by controlling the direction of temperature rise inside of the formed body, defective shapes, such as deformation of cells, can be suppressed, and the formed body can have a sufficient value of the isostatic strength when it is used as a product practically.

As described above, according to the microwave drying method of a honeycomb formed body of the present invention, a microwave reflector having a function to reflect microwaves is disposed around the honeycomb formed body, whereby temperature rises inside of the formed body can be controlled so as to allow any one of the end faces of the honeycomb formed body to reach 100° C. after the other part of the honeycomb formed body reaches 100° C. Especially, such a method is preferable for drying of a honeycomb formed body to manufacture a honeycomb structure having a thinner wall prepared using a forming raw material including more water.

The microwave drying method of a honeycomb formed body of the present invention is applicable to dry a honeycomb formed body that is formed to manufacture a honeycomb structure having a thinner wall especially, which can be favorably used as a carrier for catalyst devices or as a filter in the various fields such as automobiles, chemical, electric power, and steel.

DESCRIPTION OF REFERENCE NUMERALS

1: drying method (microwave drying method of honeycomb formed body), 10: honeycomb formed body, 11: cell, 12: conveyance pallet, 13, 14: end face, 15: center part of formed body, 20: microwave reflector, 21: reflecting face, 22: reflecting back surface, 23: through hole, D1: lower part, D2: center part, D3: upper part, W1, W2: microwaves, X: axis direction.

What is claimed is:

1. A microwave drying method of a honeycomb formed body, comprising:

an introduction step of disposing the honeycomb formed body while keeping an axis direction of cells of the honeycomb formed body vertically and introducing the honeycomb formed body into a drying furnace capable of irradiating with microwaves;

a reflector placing step of placing a microwave reflector having a function to reflect the microwaves so that a reflecting face of the microwave reflector faces at least one of upper and lower end faces of the honeycomb formed body; and a microwave drying step of irradiating with the microwaves while controlling temperature of an inside of the honeycomb formed body by the microwave reflector so that any one of end faces of the honeycomb formed body reaches 100° C. to dry the honeycomb formed body after an other part of the honeycomb formed body reaches 100° C.

2. The microwave drying method of a honeycomb formed body according to claim 1, wherein the microwave inflector includes a metal material.

3. The microwave drying method of a honeycomb formed body according to claim 1, wherein the microwave reflector includes the reflecting face of a size enabling covering of the end face of the honeycomb formed body disposed to face the microwave reflector.

4. The microwave drying method of a honeycomb formed body according to claim 1, wherein the microwave reflector is made up of a flat-plate-shaped member, and includes a plurality of through holes penetrating from the reflecting face and a reflecting back surface of the microwave reflector, and the through holes have a diameter that is ¾ or less of a wavelength of the microwaves.

5. The microwave drying method of a honeycomb formed body according to claim 1, wherein at the microwave drying step, the microwaves of 2,450 MHz or 915 MHz in frequency are applied.

* * * * *